US009182192B2

(12) United States Patent
Quail

(10) Patent No.: US 9,182,192 B2
(45) Date of Patent: Nov. 10, 2015

(54) REVERSIBLE EXPANDABLE BATON

(71) Applicant: Jeffrey James Quail, Winnipeg (CA)

(72) Inventor: Jeffrey James Quail, Winnipeg (CA)

( * ) Notice: Subject to any disclaimer, the term of this patent is extended or adjusted under 35 U.S.C. 154(b) by 0 days.

(21) Appl. No.: 14/202,907

(22) Filed: Mar. 10, 2014

(65) Prior Publication Data

US 2014/0357382 A1 Dec. 4, 2014

Related U.S. Application Data

(60) Provisional application No. 61/829,913, filed on May 31, 2013.

(51) Int. Cl.
*A63B 67/00* (2006.01)
*F41B 15/02* (2006.01)

(52) U.S. Cl.
CPC ..... *F41B 15/025* (2013.01)

(58) Field of Classification Search
CPC ..... F41B 15/02; A45B 19/04
USPC ..... 463/47.7; 135/75
See application file for complete search history.

(56) References Cited

U.S. PATENT DOCUMENTS 2,757,002 A * 7/1956 Ryden ..... 43/4
4,462,593 A * 7/1984 Carty, Jr. ..... 463/47.5
4,819,137 A * 4/1989 Hamilton ..... 362/102
5,110,375 A 5/1992 Parsons
5,348,297 A 9/1994 Parsons
5,356,139 A 10/1994 Parsons
5,407,197 A * 4/1995 Parsons ..... F41B 15/022 403/300
5,529,300 A * 6/1996 Frazier et al. ..... 463/47.4
5,542,667 A * 8/1996 Lezdey et al. ..... 463/47.4
5,839,967 A 11/1998 Moe
5,873,783 A * 2/1999 McBain et al. ..... 463/47.7
6,135,888 A * 10/2000 Hindi ..... 463/47.2
6,273,112 B1 * 8/2001 Sumida ..... 135/75
6,350,200 B2 * 2/2002 Starrett et al. ..... 463/47.2
7,416,490 B2 * 8/2008 Parsons et al. ..... 463/47.7
D710,481 S * 8/2014 Walter et al. ..... D22/117
2008/0076582 A1 * 3/2008 Chauvet et al. ..... 463/47.7
2008/0316737 A1 12/2008 Summers
2012/0129613 A1 * 5/2012 Milligan ..... 463/47.7
2014/0194212 A1 * 7/2014 Walter et al. ..... 463/47.7

* cited by examiner

*Primary Examiner* — William Pierce
(74) *Attorney, Agent, or Firm* — Ryan W. Dupuis; Kyle R. Satterthwait; Ade & Company Inc

(57) ABSTRACT

An expandable baton assembly has an outer baton section which received an intermediate baton section and an inner baton section telescopically received therein such that an overall length between two opposing working ends of the assembly can be extended for use and retracted for storage. Each of the two opposing ends is suitably arranged as both a hand grip and a striking portion such that the assembly is reversible between two different working orientations having different characteristics. The assembly can be retained in the retracted position by frictional engagement of the grip at the working end of the inner baton section within the open inner end of the outer baton section.

14 Claims, 5 Drawing Sheets

Figure 4
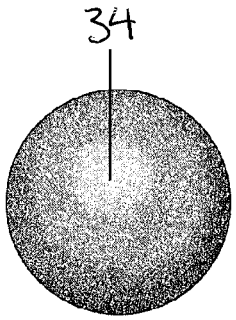
Figure 5
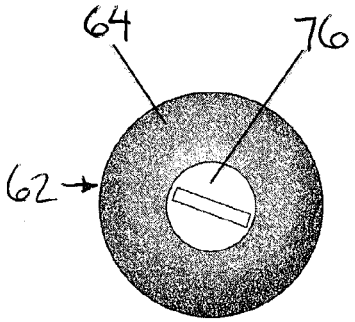
Figure 6
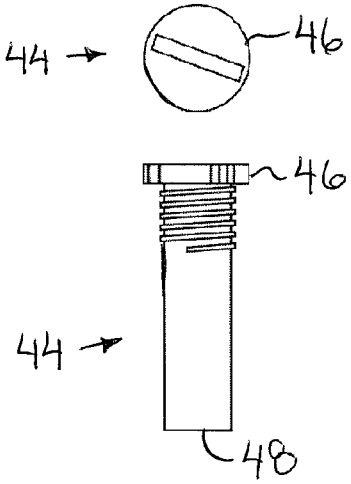
Figure 7
Figure 8
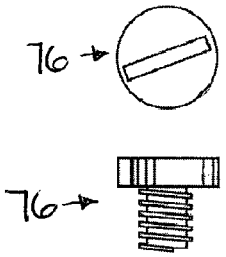
Figure 9

REVERSIBLE EXPANDABLE BATON

This application claims the benefit under 35 U.S.C. 119(e) of U.S. provisional application Ser. No. 61/829,913, filed May 31, 2013.

FIELD OF THE INVENTION

The present invention relates to expandable batons of the type commonly used by law enforcement personnel, and more particularly the present invention relates to a baton which is arranged at each of two opposing ends for both gripping or striking such that the baton may be reversibly gripped.

BACKGROUND

Law enforcement personnel commonly cite weight and size as negative factors that influence their decision to carry a baton on their duty belt. As reported in "Johnson, J. (1996). *Police impact weapons: An expanding future. Gazette: A Royal Canadian Police Publication,* 58(1), 12-15", while 10% of officers reported carrying the heavy wooden baton or truncheon at all times, 95% of officers surveyed reported that they carried a lighter and collapsible baton at all times."

Unfortunately the benefits of having a light, easily carried weapon had its downside. A study conducted by Roberts, Nokes, Leadbeatter and Pike (1994) compared the standard wooden truncheon that was being used in the United Kingdom with the baton that was being used in the United States and other European countries. The study found that the traditional truncheon's impact area was nearly double (196%) that of the expandable baton. The data set showed a greater tendency toward extended areas of bruising with the traditional truncheon or baton upon impact, while the impact area of the expandable baton was smaller and thus produced less bruising.

Various examples of batons are shown in the following United States Patent Office publications: U.S. Pat. Nos. 5,110,375 and 5,356,139, both by Parsons, U.S. Pat. No. 5,839,967 by Moe, and U.S. Pat. No.2008/0316737 by Summers. None of the prior art devices are able to realize the advantages noted above of both a heavy, wooden baton/truncheon and a lighter, collapsible baton.

SUMMARY OF THE INVENTION

According to one aspect of the invention there is provided a baton assembly which is elongate in a longitudinal direction and arranged for use against an assailant as an impact weapon, the baton assembly comprising:

an inner baton section spanning in the longitudinal direction between a working end and a sliding end; and an outer baton section spanning longitudinally between a working end and a sliding end, the sliding end of the outer baton section being open and arranged to support the inner baton section slidably therethrough in the longitudinal direction between a working position of the baton assembly in which the working ends of the inner and outer baton sections define outermost opposing ends of the baton assembly and a stored position in which the inner baton section is substantially received within the outer baton section such that an overall length of the baton assembly is reduced in relation to the working position;

each baton section including resilient material adjacent the working end of the baton section which defines a striking portion suitably arranged for striking the assailant, the striking portion of resilient material including:

a circumferential portion which is circumferentially oriented relative to the longitudinal direction; and an end portion oriented transversely to the longitudinal direction at the working end of the baton section.

The reversible grip expandable baton described herein is effectively a new weapon that provides the desirable traits of both a heavy, wooden baton/truncheon and a lighter, collapsible baton.

The invention is designed to be collapsible for easy, lighter carrying, which is the preferred baton configuration of law enforcement officers. From the collapsed state, the baton can be expanded to approximately three times the collapsed length similar to convention expandable batons. However, unlike current expandable batons the present invention has two suitable striking portions at either end of the baton and two corresponding grips at either end of the baton as well. One grip allows for the baton to be held in the traditional manner, holding it at the thickest tube of the baton and striking with the narrowest expanded tube. The second grip is located at the narrowest expanded tube allowing for the baton to be held at the narrowest end and striking to occur with the thickest tube of the baton. This turns the expandable baton into a weapon that resembles a bat.

Both grips are manufactured of thick, dense rubber that allows them to double as a striking surface. The design also creates the ability to place weight where it is optimal and protects the person being struck from the metal portions of the baton.

The advantages of this system are numerous. The traditional design of the baton being used to strike with the narrowest portion limits the amount of kinetic energy that can be generated. By having the ability to hold the narrow end, the baton resembles a bat and dramatically increases the amount of kinetic energy that can be generated.

This creates two levels of force that the user can select from. This is very important in law enforcement as the size, strength and the officer's skill will influence how much kinetic energy can be generated by a baton. By having two options available to the officer, a larger, stronger, more skilled officer can hold the baton in the traditional manner and lesson the possibility of injury through too much kinetic transfer. In contrast to this, a smaller, weaker, less skilled officer can reverse the baton and hold it in a manner that will dramatically increase their ability to create kinetic energy. This will allow officers to strike large muscle groups with the ability to end resistance with a single strike versus undesired multiple strikes.

The following is described in "Komaal Collie, B S, Brandon Wargo, M S, Christopher Berry, M S, Charlie Mesloh, PhD, "*A Pilot Sutdy of Kinetic Energy Transfer Based Upon Police Baton Designs", Law Enforcement Executive Forum,* 2009, 9(1)": "This has direct application to law enforcement as some agencies have a practice of issuing smaller batons to smaller officers. Although the smaller batons may be easier to handle, these lighter batons simply cannot generate the force of larger, heavier batons. Consequently, this practice actually works against the smaller officers by reducing the force that they are capable of delivering. A baton that is too light or too small may cause an officer to strike a subject repeatedly to effectively control a suspect, which is perceived badly by both the media and the public. While a heavier baton is more likely to cause injury, this risk is reduced when strikes are properly delivered to an approved target area on the body and is more likely to be effective in a single strike. The most practical, less-than-lethal force option is one that incapacitates with the least number of applications."

Preferably the end portion of resilient material of the outer baton section fully spans a respective end face at the working end of the outer baton section.

When the outer baton section includes a tubular housing and an end cap threadably secured to the tubular housing at the working end, preferably the end cap including the end portion and at least a portion of the circumferential portion supported thereon so as to be selectively separable together with the end cap relative to the tubular housing.

Preferably the working end of the inner baton section is frictionally engaged within the sliding end of the outer baton section in the storage position so as to be arranged to retain the inner baton section within the outer baton section in the storage position solely by the frictional engagement therebetween.

Preferably the inner baton section comprises a rigid shaft and a handle portion of resilient material surrounding at least a portion of the shaft adjacent the working end thereof so as to be suitably arranged to receive a hand of a user gripped thereon, in which the striking portion of resilient material is increased in diameter relative to the resilient material of the handle portion.

Preferably the resilient material of the handle portion adjacent the working end of the inner baton section is arranged to be frictionally engaged within the sliding end of the outer baton section in the storage position so as to be arranged to frictionally retain the inner baton section within the outer baton section in the storage position.

An outer diameter of the circumferential portion of the striking portion at the working end of the inner baton section may be substantially equal to an outer diameter at the sliding end of the outer baton section.

Preferably an intermediate baton section is received within the outer baton section so as to be slidable in the longitudinal direction relative to the outer baton section between the stored position and the working position. Preferably the intermediate baton section receives the inner baton section therein such that the inner baton section is slidable in the longitudinal direction relative to the intermediate position between the stored position and the working position.

When the intermediate baton section extends longitudinally between a first end which is nearest to the working end of the outer baton section and a second end which is nearest to the working end of the inner baton section, preferably i) the first end of the intermediate baton section is arranged to be frictionally wedged within the sliding end of the outer baton section in the working position of the baton assembly, and ii) the first end of the intermediate baton section includes an inner striking surface which is arranged to be abutted by the sliding end of the inner baton section as the inner baton section is slidably retracted relative to the intermediate baton section towards the stored position of the baton assembly.

Preferably the inner striking surface is defined on a cap member which is threadably secured to the intermediate baton section so as to be readily separable from the intermediate baton section.

When the inner baton section comprises a rigid shaft extending between the first and second ends thereof and a handle portion of resilient material surrounding at least a portion of the shaft adjacent the working end thereof so as to be suitably arranged to receive a hand of a user gripped thereon, preferably the sliding end of the inner baton section is arranged to abut the inner striking surface at the first end of the intermediate baton section without substantially resilient deforming the handle portion at the working end of the inner baton section by engagement with the second end of the intermediate baton section as the inner baton section is slidably retracted relative to the intermediate baton section towards the stored position of the baton assembly.

Preferably the working end of the inner baton section includes a rigid element at an outermost end of the baton assembly which is integral with the rigid shaft and which is surrounded by the respective end portion of the resilient material at the working end of the inner baton section.

According to a second aspect of the present invention there is provided a method of use of the baton assembly described herein comprising: i) grasping the outer baton section in a hand of a user adjacent the working end in the working position of the baton assembly corresponding to a first orientation of the baton assembly; ii) extending the baton assembly from the stored position to the working position; and iii) enabling a user to grasp the inner baton section in said hand at an intermediate location which is longitudinally inward from the striking portion of the inner baton section corresponding to a second orientation of the baton assembly.

According to another aspect of the present invention there is provided a baton assembly which is elongate in a longitudinal direction and arranged for use against an assailant as an impact weapon, the baton assembly comprising:

an inner baton section spanning in the longitudinal direction between a working end and a sliding end, the inner baton section including resilient material adjacent the working end thereof which defines a striking portion suitably arranged for striking the assailant; and an outer baton section spanning longitudinally between a working end and a sliding end, the sliding end of the outer baton section being open and arranged to support the inner baton section slidably therethrough in the longitudinal direction between a working position of the baton assembly in which the working ends of the inner and outer baton sections define outermost opposing ends of the baton assembly and a stored position in which the inner baton section is substantially received within the outer baton section such that an overall length of the baton assembly is reduced in relation to the working position;

the working end of the inner baton section being arranged to be frictionally engaged within the sliding end of the outer baton section in the storage position so as to be arranged to frictionally retain the inner baton section within the outer baton section in the storage position.

According to a further aspect of the present invention there is provided a baton assembly which is elongate in a longitudinal direction and arranged for use against an assailant as an impact weapon, the baton assembly comprising:

an inner baton section spanning in the longitudinal direction between a working end and a sliding end, the inner baton section including resilient material adjacent the working end thereof which defines a striking portion suitably arranged for striking the assailant;

an outer baton section spanning longitudinally between a working end and a sliding end, the sliding end of the outer baton section being open and arranged to support the inner baton section slidably therethrough in the longitudinal direction between a working position of the baton assembly in which the working ends of the inner and outer baton sections define outermost opposing ends of the baton assembly and a stored position in which the inner baton section is substantially received within the outer baton section such that an overall length of the baton assembly is reduced in relation to the working position; and an intermediate baton section which is received within the outer baton section so as to be slidable in the longitudinal direction relative to the outer baton section between the stored position and the working position;

the intermediate baton section receiving the inner baton section therein such that the inner baton section is slidable in the longitudinal direction relative to the intermediate position between the stored position and the working position;

the intermediate baton section extending longitudinally between a first end which is nearest to the working end of the outer baton section and a second end which is nearest to the working end of the inner baton section;

the first end of the intermediate baton section being arranged to be frictionally wedged within the sliding end of the outer baton section in the working position of the baton assembly; and the first end of the intermediate baton section including an inner striking surface which is arranged to be abutted by the sliding end of the inner baton section as the inner baton section is slidably retracted relative to the intermediate baton section towards the stored position of the baton assembly.

One embodiment of the invention will now be described in conjunction with the accompanying drawings in which:

BRIEF DESCRIPTION OF THE DRAWINGS

FIG. 4 is an end view of the working end of the outer baton section of the baton assembly;

FIG. 5 is an end view of the working end of the inner baton section of the baton assembly;

FIG. 6 is an end view of an end cap defining an inner striking surface for mounting across the first end of the intermediate baton section of the baton assembly;

FIG. 7 is a side elevational view of the end cap according to FIG. 6;

FIG. 8 is an end view of an end screw which defines an outermost end of inner baton section of the baton assembly;

FIG. 9 is a side elevational view of the end screw according to FIG. 8;

In the drawings like characters of reference indicate corresponding parts in the different figures.

DETAILED DESCRIPTION

Figure 11:
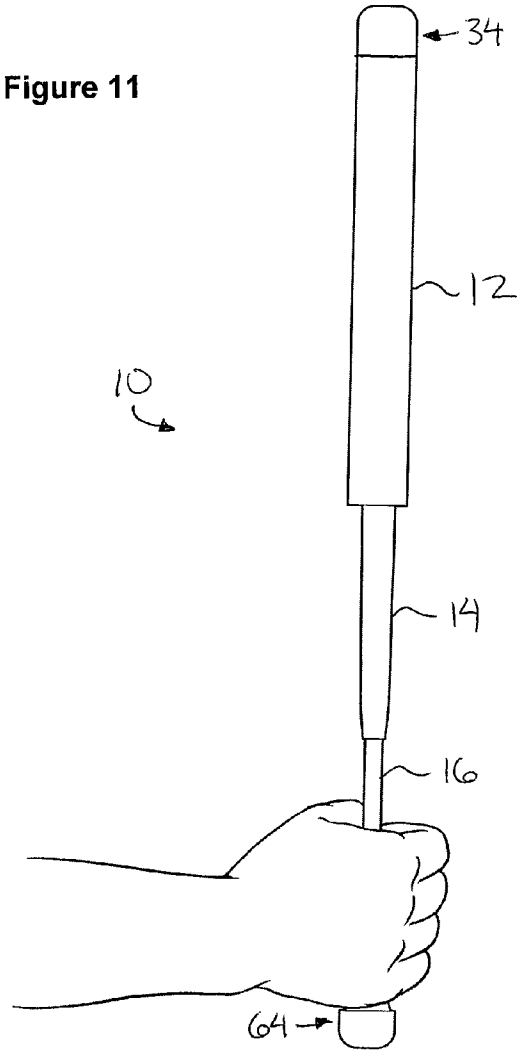
FIG. 11 is a perspective view of the baton assembly gripped by a user in a second orientation which is reversed relative to the first orientation of FIG. 10.
Figure 10:
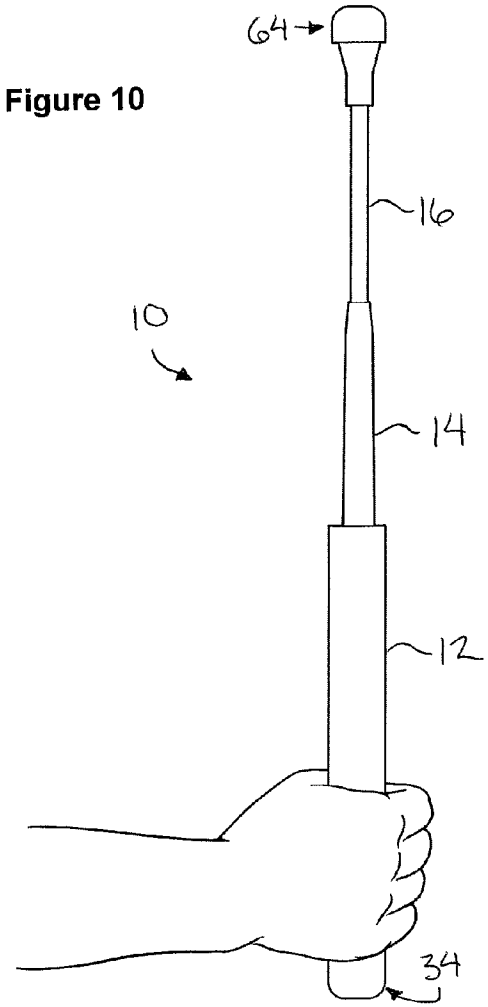
FIG. 10 is a perspective view of the baton assembly gripped by a user in a first orientation.

Referring to the accompanying figures, there is illustrated an extendable baton assembly generally indicated by reference numeral 10. The assembly 10 is generally elongate in a longitudinal direction between two opposing working ends. Each of the two opposed working ends defines both a handle gripping area and a striking portion suitable for use by law enforcement officers for striking or impacting an assailant or opponent or the like. In this instance, the extended baton assembly can be gripped in a first orientation as shown in FIG. 10, or reversibly in an opposing second orientation as shown in FIG. 11.

Figure 1:
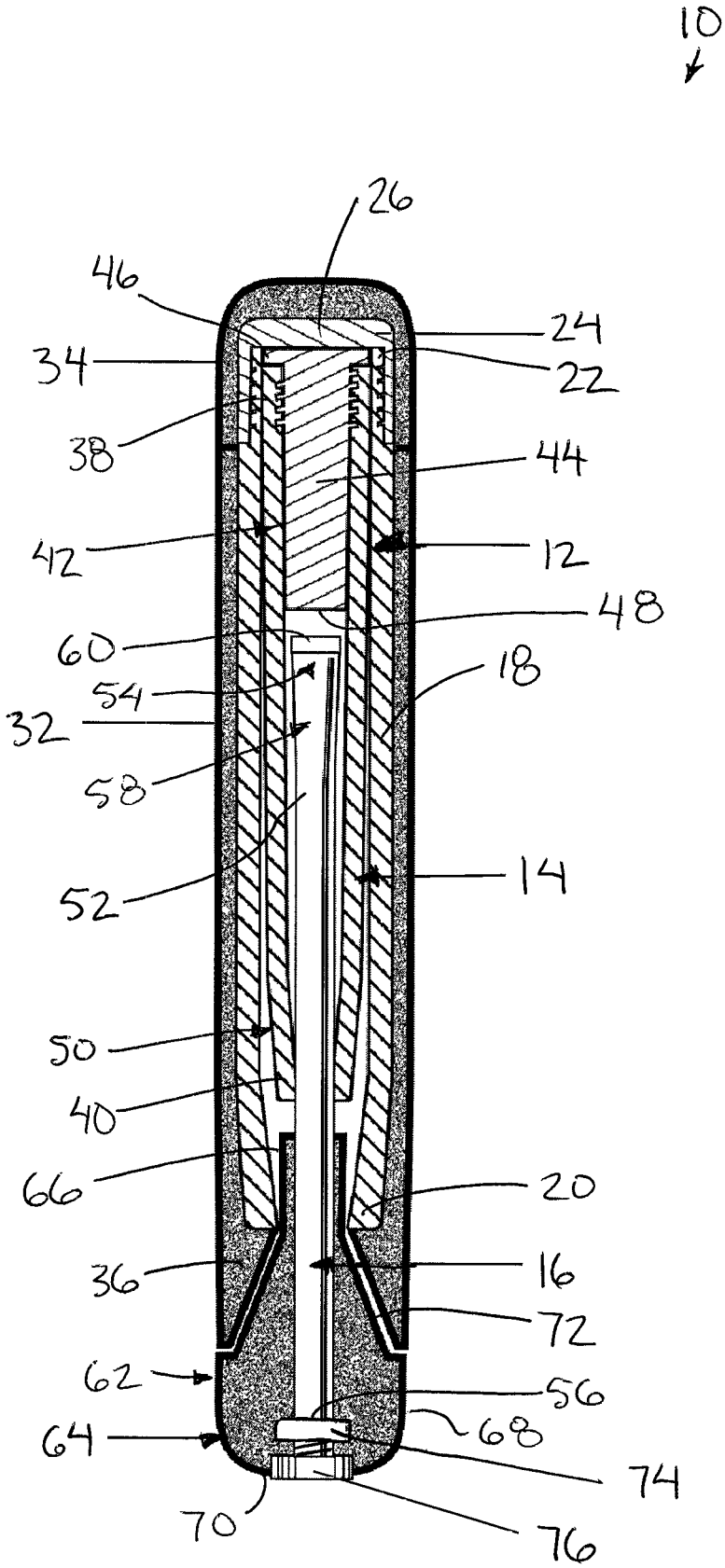
FIG. 1 is cut-away side view of the baton assembly in a collapsed and stored position.

The baton assembly 10 generally includes an outer baton section 12, an intermediate baton section 14 which is telescopically received within the outer baton section, and an inner baton section 16 which is telescopically received within the intermediate baton section. The three sections permits the overall baton assembly to be collapsed into a storage position as shown in FIG. 1 in which the intermediate baton section is fully received within the outer baton section and a substantial portion of the inner baton section is received within both the intermediate and outer baton sections. When telescopically extended, the baton assembly can be extended from the stored position to a working position in which the overall length is considerably increased such that a majority of the intermediate baton section projects outwardly from the outer baton section and the majority of the inner baton section projects outwardly from the intermediate baton section.

The outer baton section 12 generally includes a rigid tube 18 extending longitudinally from a sliding end 20 to a working end 22. The working end 22 of the outer baton section defines one of the two opposing working ends of the overall baton assembly. The working end of the rigid tube is externally threaded to threadably receive an end cap 24 thereon. The end cap includes an internally threaded collar portion threaded onto the exterior of the rigid tube such that the exterior of the collar portion of the end cap and the remainder of the rigid tube are substantially flush and of constant diameter with one another. The end cap further includes an end wall 26 spanning the outer end of the collar portion to fully enclose the end of the rigid tube 18 when secured thereon.

The opposing sliding end 20 of the outer baton section 12 tapers inwardly such that both the outer and inner diameters are gradually reduced at an inner end portion 30 of the rigid tube to a minimum inner diameter at the innermost terminal end of the tube corresponding to the sliding end 20.

Resilient material is provided about the outer baton section in the form of both a sleeve portion 32 and a cap portion 34. The sleeve portion 32 spans the full length of the rigid tube 18 from an outer end adjacent the external threads at the working end to an opposing inner end which projects inwardly beyond the sliding end of the tube. The outer diameter of the sleeve portion is substantially constant along the full length thereof. The inner diameter is similarly substantially constant over the main portion of the rigid tube, however the inner diameter is reduced to follow the profile of the inner end portion of the tube towards the sliding end 20.

At a protruding portion 36, protruding beyond the sliding end of the tube, the inner diameter is yet further reduced to define an inner shoulder which is substantially perpendicular to the longitudinal direction for abutment against the end face of the rigid tube 18. The remainder of the protruding portion 36 has an interior diameter which gradually increases linearly to the pre-inner end of the sleeve portion.

The sleeve portion 32 mainly serves to define a handle which is suitable for being gripped in the hand of the user in the first orientation of the baton assembly.

The cap portion 34 of the resilient material is secured about the end cap 34 to remain attached with the end cap as the end cap is detached and reattached to the rigid tube. The cap portion 34 includes a circumferential portion which is generally cylindrical for surrounding the collar portion of the end cap. The cap portion 34 further includes an end portion which spans perpendicularly to the longitudinal direction across the full end wall 26 of the end cap. The outer diameter of the circumferential portion is approximately equal to the outer diameter of the sleeve portion 32 of resilient material so as to be substantially flush therewith when the end cap 24 is secured in a mounted position at the working end of the rigid tube. A gradual radius of curvature is defined between the cylindrical outer surface of the circumferential portion and the perpendicular end portion.

The cap portion 34 of the resilient body primarily defines a striking portion together with an outermost portion of the sleeve portion 32 when gripped in the opposing second orientation shown in FIG. 11.

The intermediate baton section 14 also comprises a generally rigid tube which extends longitudinally from a first end 38 to a second end 40. The main central portion of the rigid tube is substantially constant in outer diameter, or is only slightly tapered from the first end to the second end. In either instance, the outer diameter is arranged to be less than the inner diameter at the sliding end 20 of the outer baton section along substantially the full length of the main portion such that the intermediate baton section remain readily slidable through the open sliding end of the outer baton section between the stored and extended positions.

A first end portion 42 of the intermediate baton section which is nearest the first end 30 is gradually increased in diameter such that the outer diameter at the first end is greater than the interior diameter of the sliding end of the outer baton section. In this manner, the intermediate baton section becomes wedged within the sliding end of the outer baton section to be frictionally retained relative to one another and to prevent the intermediate baton section from being fully extended outwardly from the outer baton section in the extended position.

The first end of the intermediate baton section further includes a cap member 44 which is secured threadably within the rigid tube to be selectively removable therefrom as may be desired for maintenance and the like. The cap member 44 includes a main cylindrical body which spans substantially the full interior dimension of the intermediate baton section. The cylindrical body is threaded adjacent the outer end thereof for mating threaded connection with internal threads at the first end of the rigid tube.

An annular flange 46 is provided at the outer end of the cylindrical body for abutment with the end face at the first end of the rigid tube. The flange 46 abuts the end of the tube to control the depth and location of the cap member relative to the interior of the intermediate baton section in a mounted position.

The inner end of the cap member 44 comprises an inner striking surface 48 which is perpendicular to the longitudinal direction and spans the entire cross sectional area of the interior of the rigid tube to enclose the first end of the intermediate baton section. The function of the inner striking surface 48 will be described in further detail below.

At the second end of the intermediate baton section a second end portion 50 is defined in which the interior diameter is reduced, as well as the outer diameter, to a minimum dimension at the outermost end of the rigid tube. The second end remains open however for slidably receiving the inner baton section therethrough in use.

In the stored position, the intermediate baton section is received within the outer baton sections such that the first end of the intermediate section abuts the end wall of the end cap at the working end of the outer baton section. The intermediate baton section is shorter than the rigid tube of the outer baton section such that the second end of the intermediate baton section is spaced longitudinally inward from the sliding end 20 of the rigid tube of the outer baton section when stored.

The inner baton section 16 includes a rigid shaft 52 which may comprise a solid rod or a hollow tube. A main portion of the shaft has a constant outer diameter which is smaller than the inner diameter at the second end of the intermediate baton section so as to be readily slidable therethrough.

The rigid shaft extends longitudinally between a sliding end 54 at the inner end for being slidably received into the intermediate baton section and an opposing working end 56 which defines the other outermost end of the overall baton assembly opposite form the working end 22 of the outer baton section.

An end portion 58 of the shaft adjacent the sliding end 54 includes an outer diameter which is gradually increased to the innermost end of the shaft where the outer diameter is greater than the inner diameter at the second end of the outer baton section. In this manner, the inner baton section is prevented from being slidably extended fully out of the intermediate section. As the inner baton section is slidably extended out of the intermediate baton section, the end portion instead becomes wedged within the smaller inner diameter of the second end portion 50 of the intermediate baton section to remain frictionally engaged therein in the extended position.

The shaft includes an end face 60 which is perpendicular to the longitudinal direction at the sliding end of the shaft so as to be arranged for abutment with the inner striking surface 48 as the inner baton section is slidably retracted into the intermediate baton section. The overall length of the rigid shaft 52 is approximately equal to the overall length of the rigid tube forming the outer baton section. Accordingly, when the sliding end of the inner baton section abuts the inner striking surface 48 of the cap member within the intermediate baton section and the first end of the intermediate baton section is in turn abutted against the end wall of the outer baton section, the inner baton section remains protruding outward beyond the sliding end of the rigid tube 18 by an amount which corresponds approximately to the length of the cap member 44 between the longitudinally opposed ends thereof.

The inner baton section also includes a resilient material body 62 secured to the working end thereof. Similarly to the outer baton section, the resilient material body 62 of the inner baton section defines both a striking portion 64 and a handle portion 66.

Also similarly to the outer baton section, the striking portion of the inner baton section includes a circumferential portion 68 which is generally cylindrical and has an outer diameter which is substantially equal to the outer diameter of the sleeve portion 32 on the outer baton section so as to be substantially flush at the outer side thereof. In the stored position, the inner end of the circumferential portion is arranged to substantially abut the corresponding innermost end of the sleeve portion 32 on the outer baton section. The striking portion 64 also includes an end portion 70 which extends transversely to the longitudinal direction of the baton assembly at the outermost end of the inner baton section.

The resilient material body 62 also includes an intermediate portion 72 where the outer diameter is gradually reduced from the striking portion to the handle portion 66 which is spaced longitudinally inward relative to the striking portion. The outer diameter of the resilient body is reduced gradually to the smallest diameter thereof at the handle portion where the remainder of the resilient body has a substantially constant outer diameter along the rigid shaft.

The outer diameter of the handle portion is only slightly smaller than the interior diameter defined at the sliding end of the rigid tube 18 such that the resilient material is arranged to be slightly compressed when received within the sliding end of the rigid tube to frictionally retain the handle portion of the resilient body 62 within the interior of the sliding end of the outer baton section in the stored position.

In the stored position, the gradual tapering of the outer diameter of the intermediate portion 72 is approximately equal to the gradual change in inner diameter of the protruding portion 36 of the sleeve of resilient material 32 on the outer baton section for close fitting engagement therebetween.

The resilient material body 62 includes a rigid washer 74 embedded therein at a central location within the striking portion 64. The washer 74 is a rigid material having an outer diameter which is greater than the shaft 52 of the inner baton section.

In an assembled configuration, the shaft is inserted through the resilient material body 62 to span the handle portion and the intermediate portion thereof and abut an innermost side of the rigid washer 74 within the striking portion. An end fastener 76 is arranged to be inserted through the outermost end of the striking portion to clamp a portion of the resilient body between the head of the end fastener 76 and the outside of the rigid washer 74, and in turn clamp the rigid washer 74 against the outermost end of the shaft 52.

The outer face of the head of the end fastener 76 defines the center of the outermost end face at the working end of the intermediate baton section which is oriented perpendicularly to the longitudinal direction. The fastener 76 provides a direct rigid connection from the outermost end face to the rigid shaft of the inner baton section, which is in turn arranged for abutment at the sliding end thereof with the inner striking surface 48 within the intermediate baton section as described further below.

The various elements of the baton assembly are assembled with one another by first attaching the resilient material of the outer baton section, including the sleeve portion 32 and the cap portion 36 to the rigid tube and end cap respectively. These resilient bodies typically remain attached to their respective components throughout subsequent disassembly of the baton assembly for maintenance and the like. Next, the shaft 52 is slidably inserted through the first end of the intermediate section followed by threaded securement of the cap member at the first end of the intermediate baton section to retain the inner baton section slidably therein. Subsequently, the intermediate baton section is slidably received through the open working end of the outer baton section followed by threaded connection of the end cap 24 to the outermost working end of the outer baton section to slidably retain the intermediate baton section therein. In this position, the inner and intermediate baton sections can be slidably extended outward from the outer baton section sufficiently that the resilient material body 62 of the inner baton section can be secured to the working end thereof. In the assembled position, the striking portion 64 of the inner baton section is retained thereon by the end fastener 76.

Figure 2:
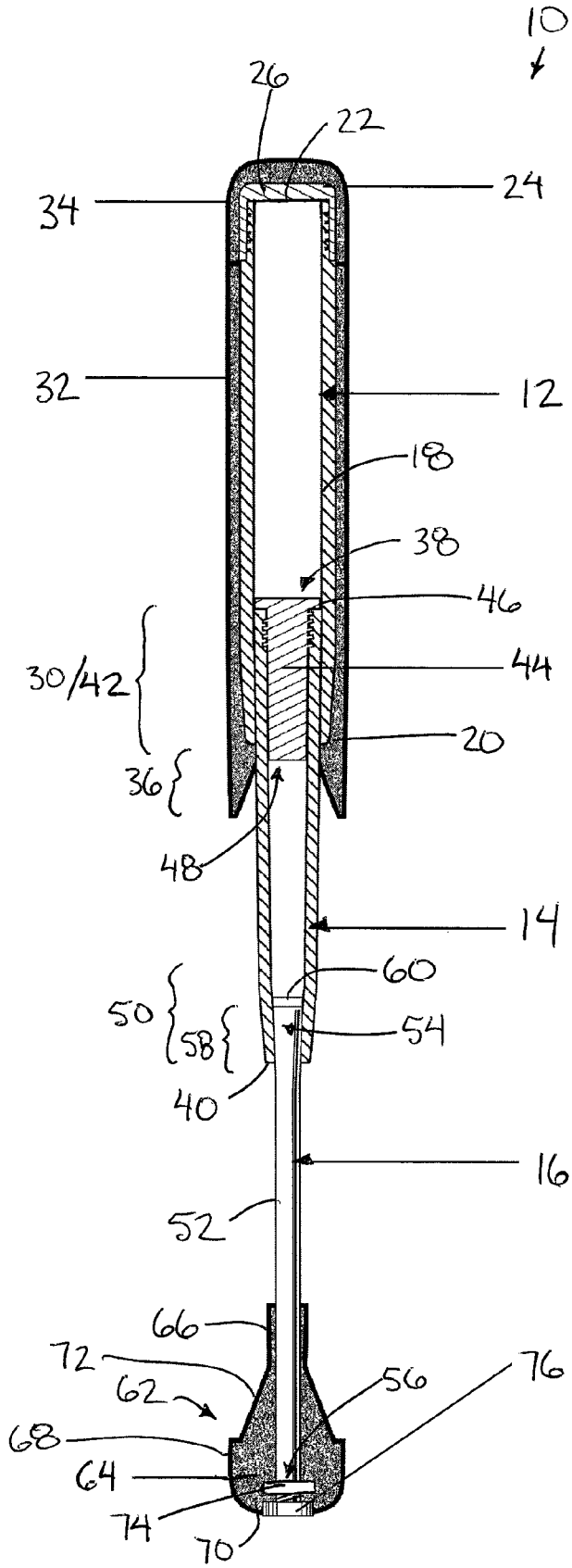
FIG. 2 is a cut-away side view of the baton assembly in an extended and working position.
Figure 3:
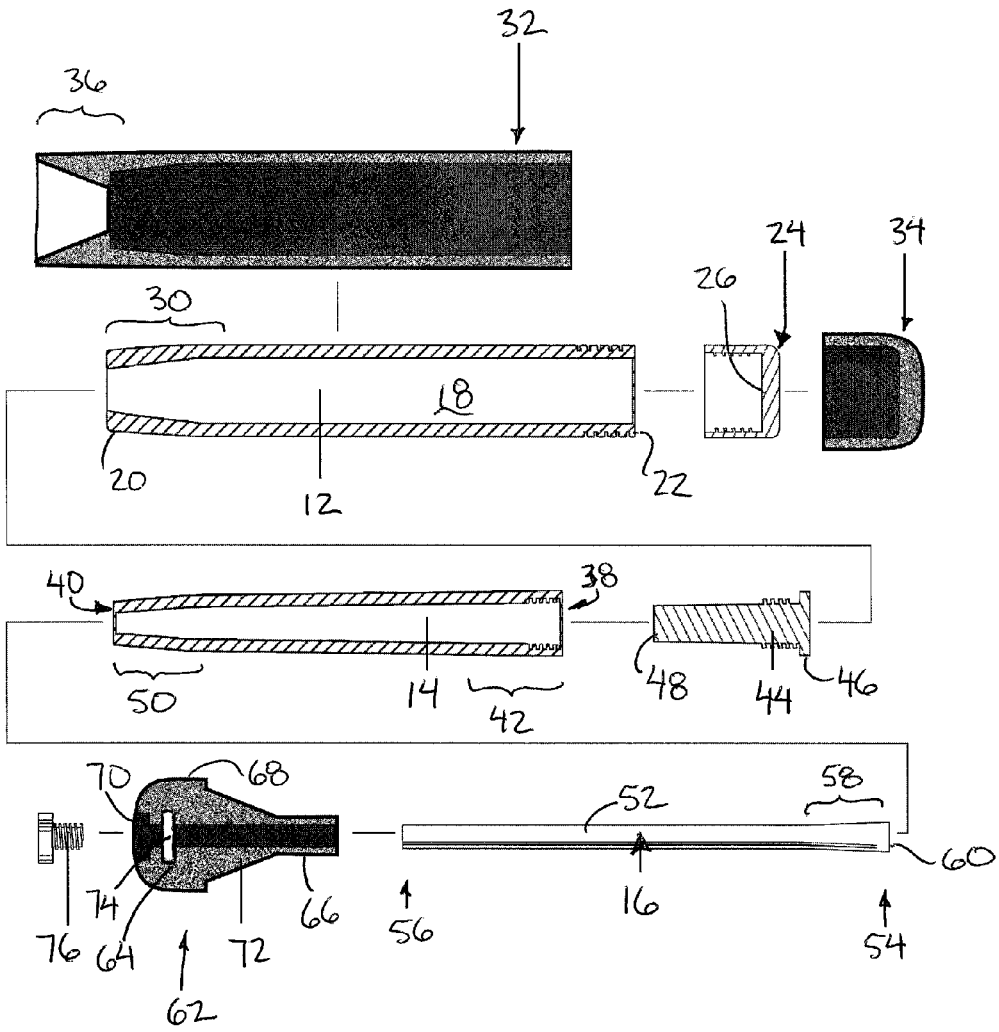
FIG. 3 is a cut-away exploded view of the baton assembly.

When it is desired to perform maintenance on the baton assembly, for example for cleaning and the like, the resilient material body 62 is removed by removing the end fastener 76, followed by threaded removal of the end cap 24 and the cap member 44 from their respective components to permit the inner baton section, the intermediate baton section and the outer baton section to be slidably separated from one another. As shown in FIGS. 1 and 2, the handle portion 66, that is reduced in diameter relative to the striking portion 68 at the working end of the inner baton section, extends along a portion of the shaft from the working end towards the sliding end of the inner baton section inwardly beyond the releasable connection of the fastener 76 which retains the striking portion on the end of the rigid shaft, such that the handle portion 66 is suitably arranged to receive a hand of a user gripped thereon.

Typically, the baton assembly is carried in the stored position in which the intermediate baton section is fully received within the outer baton section and the majority of the inner baton section is received within both the intermediate and outer baton sections.

When it is desired to use the baton assembly as a weapon, the user first grasps the handle portion of the outer baton section and performs a swinging motion to create sufficient momentum with the striking portion at the working end of the inner baton section to overcome the friction between the handle portion of the inner baton section frictionally wedged within the inner diameter at the inner sliding end of the outer baton section and permit the baton sections to be telescopically extended relative to one another from the stored and collapsed position of shortest overall length to the working position of greatest overall length between the two opposing working ends.

In a first orientation of use, the user maintains their same grip on the handle portion of the outer baton section. However, for use in the second orientation, the user can instead grasp the inner baton section at an intermediate location about the handle portion 66 at the location which is longitudinally inward from the increased outer diameter of the striking portion 64. In this orientation the striking portion of the outer baton section is used for striking assailants and the like.

The baton assembly is generally retained in the working position by the sliding end of the inner baton section being wedged within the second end of the intermediate baton section and the first end of the intermediate baton section in turn being wedged within the sliding end of the outer baton section. To break the frictional engagement between the baton sections, the end fastener 76 at the outermost end of the inner baton section is impacted, for example by striking against a hard surface, with sufficient force to break the friction at least between one of the adjacent pairs of baton sections.

Where friction between the intermediate and outer baton sections is first broken, the intermediate section slides into the outer section until the first end of the intermediate section abuts the end wall at the working end of the outer baton section. Any subsequent impact on the end fastener will break the wedge friction between the inner and intermediate baton sections.

Alternatively, if friction between the inner and intermediate baton sections is first broken by the first impact, the inner baton section is slidably retracted into the intermediate baton section until the sliding end of the inner baton section abuts the inner striking surface at the first end of the intermediate baton section. The impact between the sliding end of the inner baton section with the cap member at the first end of the intermediate baton section then serves to break the friction between the intermediate and outer baton sections.

In either instance, the sliding end of the inner baton section always abuts the inner striking surface of the intermediate baton section prior to the second end of the intermediate section abutting the innermost end of the handle portion of the resilient body as the baton sections are retracted from the extended position to the stored position.

In either the first or second orientations the respective striking portions have similar outer diameter at the circumferential portion thereof and both have a similar radius of curvature transitioning from the circumferential portion to the end portion oriented perpendicularly to the longitudinal direction.

As described herein, in the collapsed state of the baton assembly, the hollow outer tube acts as a container for both the hollow middle tube and the inner end shaft. The end cap cover is affixed to the end cap which is screwed onto the end of the hollow outer tube. This prevents the inner tubes from falling out the back of the baton in the collapsed position. The small grip holds the baton collapsed through the friction of being inserted into the hollow outer tube and the large grip.

As further described herein, in the expanded state, the baton stays locked in the expanded position through the friction of the thicker end of the hollow middle tube action on the narrow end of the hallow outer tube. The same friction occurs as the thick end of the end shaft meets with the thin end of the hollow middle tube. This friction keeps the baton locked in an expanded state.

When the baton is being moved from the expanded state to the collapsed state, the user holds the baton with the screw in tip facing the ground and strikes the screw in tip against a hard surface. This will cause the end shaft to unlock from the hollow middle tube. The user then strikes the screw in tip again and the end shaft moves up the hollow middle tube and presses against the hollow middle tube plug which breaks the friction lock between the hollow middle tube and the hollow outer tube.

The baton is designed to allow for complete de-assembly for cleaning, maintenance and warranty work. To de-assemble, the operator first unscrews the screw in tip and removes the small grip from the end shaft. The operator then unscrews the end cap rom the hollow outer tube. This allows the hollow middle tube and the end shaft to be removed from the hollow outer tube. The operator then unscrews the middle tube plug from the hollow middle tube. This allows the end shaft to be removed from the hollow middle tube.

In operation, when the baton is collapsed, the baton shrinks in size to approximately ⅓ its expanded length. This allows the baton to be discreetly carried in a scabbard on the duty belt of a law enforcement officer or concealed by someone carrying the weapon for self defense.

When the operator requires the baton, it can be removed from the scabbard and expanded to approximately three times the collapsed length. The baton should be extended by holding one of the two grips available on the baton. If it is swung downwards with force, the centrifugal force combined with the assistance of gravity will expand the baton and allow the friction of the expanding tubes to lock into place.

The operator should then evaluate the totality of the circumstances they find themselves in. If they feel they are need of more kinetic energy when striking with the baton, they should grab the baton by the small grip and strike, making contact with the large grip. If the situation indicates that they may need less kinetic energy, they would grab the baton by the large grip and strike, making contact with the small grip.

When the baton is no longer required, they would hold the baton in a vertical fashion and slam the tip into hard ground causing the friction locks to unlock and the baton to collapse. The user then pushes the extension of the small grip into the hollow outer tube to lock it in the collapsed position. The baton can then be placed back in the scabbard.

Since various modifications can be made in my invention as herein above described, many apparently widely different embodiments can be made without departing from the scope of the invention. For example in alternative embodiments, different materials, sizes and textures can be used for all components and some materials may be permanently attached instead of removable. Furthermore, various methods can be used for locking the baton sections in the collapsed/stored portion or the expanded/working position. It is intended that all matter contained in the accompanying specification shall be interpreted as illustrative only and not in a limiting sense.

The invention claimed is:

1. A baton assembly which is elongate in a longitudinal direction and arranged for use against an assailant as an impact weapon, the baton assembly comprising:

an inner baton section including a rigid shaft spanning in the longitudinal direction between a working end and a sliding end and a resilient material adjacent the working end thereof which is more resilient than the rigid shaft and which defines i) a striking portion suitably arranged for striking the assailant and ii) a handle portion having a reduced diameter relative to the striking portion which extends inwardly from the striking portion towards the sliding end along at least a portion of the shaft so as to be suitably arranged to receive a hand of a user gripped thereon; and an outer baton section including a rigid tube spanning longitudinally between a working end and a sliding end, the sliding end of the outer baton section being open and arranged to support the inner baton section slidably therethrough in the longitudinal direction between a working position of the baton assembly in which the working end of the inner baton section defines an outermost first end of the baton assembly and the working end of the outer baton section defines an outermost second end of the baton assembly and a stored position in which the inner baton section is substantially received within the outer baton section such that an overall length of the baton assembly between the outermost first and second ends is reduced in relation to the working position;

wherein the handle portion of the resilient material at the working end of the inner baton section has an outer diameter which is sized relative to an inner diameter of the sliding end of the outer baton section such that the handle portion of the resilient material is compressed and frictionally engaged relative to the sliding end of the outer baton section when received within the sliding end of the outer baton section in the storage position whereby the inner baton section is retained within the outer baton section in the storage position by the compression of the handle portion of the resilient material at the working end of the inner baton section and the sliding end of the outer baton section.

2. The baton assembly according to claim 1 wherein the striking portion of the resilient material at the working end of the inner baton section comprises a first striking portion including:

a circumferential portion which is circumferentially oriented relative to the longitudinal direction; and an end portion oriented transversely to the longitudinal direction at the outermost first end of the baton assembly; and wherein the outer baton section includes a resilient material adjacent the working end of the outer baton section which is more resilient than the rigid tube and which defines a second striking portion at the outermost second end of the baton assembly in the working position suitably arranged for striking the assailant, the resilient material at the outermost second end of the baton assembly in the working position including:

a circumferential portion which is circumferentially oriented relative to the longitudinal direction; and an end portion oriented transversely to the longitudinal direction at the outermost second end of the baton assembly.

3. The baton assembly according to claim 2 wherein the end portion of the resilient material of the second striking portion of the outer baton section fully spans a respective end face at the outermost second end of the baton assembly.

4. The baton assembly according to claim 2 wherein the outer baton section includes an end cap threadably secured to the rigid tube at the working end, the end cap including the end portion of the resilient material defining the second striking portion and at least a portion of the circumferential portion of the resilient material defining the second striking portion supported thereon so as to be selectively separable together with the end cap relative to the tubular housing.

5. The baton assembly according to claim 1 wherein an outer diameter of the striking portion at the working end of the inner baton section is substantially equal to an outer diameter of the outer baton section at the sliding end of the outer baton section.

6. The baton assembly according to claim 1 further comprising an intermediate baton section which is received within the outer baton section so as to be slidable in the longitudinal direction relative to the outer baton section between the stored position and the working position, the intermediate baton section receiving the inner baton section therein such that the inner baton section is slidable in the longitudinal direction relative to the intermediate position between the stored position and the working position.

7. The baton assembly according to claim 6 wherein:

the intermediate baton section extends longitudinally between a first end which is nearest to the working end of the outer baton section and a second end which is nearest to the working end of the inner baton section;

the first end of the intermediate baton section being arranged to be frictionally wedged within the sliding end of the outer baton section in the working position of the baton assembly; and the first end of the intermediate baton section including an inner striking surface which is arranged to be abutted by the sliding end of the inner baton section as the inner baton section is slidably retracted relative to the intermediate baton section towards the stored position of the baton assembly.

8. The baton assembly according to claim 7 wherein the inner striking surface is defined on a cap member which is threadably secured to the intermediate baton section so as to be readily separable from the intermediate baton section.

9. The baton assembly according to claim 7 wherein:

the sliding end of the inner baton section is arranged to abut the inner striking surface at the first end of the intermediate baton section without resiliently deforming the handle portion at the working end of the inner baton section by engagement with the second end of the intermediate baton section as the inner baton section is slidably retracted relative to the intermediate baton section towards the stored position of the baton assembly.

10. The baton assembly according to claim 6 wherein:

the sliding end of the inner baton section is arranged to be frictionally wedged within the second end of the intermediate baton section in the working position of the baton assembly; and the working end of the inner baton section includes a rigid element at an outermost end of the baton assembly which is integral with the rigid shaft and which is surrounded by the respective end portion of the resilient material at the working end of the inner baton section.

11. The baton assembly according to claim 1 further comprising:

an intermediate baton section which is received within the outer baton section so as to be slidable in the longitudinal direction relative to the outer baton section between the stored position and the working position;

the intermediate baton section receiving the inner baton section therein such that the inner baton section is slidable in the longitudinal direction relative to the intermediate position between the stored position and the working position;

the intermediate baton section extending longitudinally between a first end which is nearest to the working end of the outer baton section and a second end which is nearest to the working end of the inner baton section;

the first end of the intermediate baton section being arranged to be frictionally wedged within the sliding end of the outer baton section in the working position of the baton assembly; and the first end of the intermediate baton section including an inner striking surface which is arranged to be abutted by the sliding end of the inner baton section as the inner baton section is slidably retracted relative to the intermediate baton section towards the stored position of the baton assembly.

12. The baton assembly according to claim 11 wherein the sliding end of the inner baton section is arranged to abut the inner striking surface at the first end of the intermediate baton section without resiliently deforming the handle portion at the working end of the inner baton section by engagement with the second end of the intermediate baton section as the inner baton section is slidably retracted relative to the intermediate baton section towards the stored position of the baton assembly.

13. A baton assembly which is elongate in a longitudinal direction and arranged for use against an assailant as an impact weapon, the baton assembly comprising:

an inner baton section including a rigid shaft spanning in the longitudinal direction between a working end and a sliding end and a resilient material adjacent the working end thereof which is more resilient than the rigid shaft and which is retained on the rigid shaft by a releasable connection which allows ready separation of the resilient material from the rigid shaft, the resilient material including i) a striking portion having a prescribed outer diameter so as to be suitably arranged for striking the assailant, ii) a handle portion supported about the rigid shaft of the inner baton section inwardly of the striking portion so as to extend along at least a portion of the rigid shaft inwardly beyond said releasable connection of the resilient material and having a substantially constant outer diameter along the rigid shaft which is less than the prescribed outer diameter of the striking portion so as to be suitably arranged to receive a hand of a user gripped thereon, and iii) an intermediate portion supported about the rigid shaft of the inner baton section to extend between the striking portion and the handle portion and having an outer diameter which is reduced from the striking portion to the handle portion; and an outer baton section spanning longitudinally between a working end and a sliding end, the sliding end of the outer baton section being open and arranged to support the inner baton section slidably therethrough in the longitudinal direction between a working position of the baton assembly in which the working end of the inner baton section defines an outermost first end of the baton assembly and the working end of the outer baton section defines an outermost second end of the baton assembly and a stored position in which the handle portion of the inner baton section is received within the outer baton section such that an overall length of the baton assembly between the outermost first and second ends is reduced in relation to the working position.

14. The baton assembly according to claim 13 further comprising:

a rigid annular member embedded within the resilient material at the working end of the inner baton section;

the rigid annular member being fixed relative to the rigid shaft of the inner baton section; and the rigid annular member being larger in diameter than the rigid shaft of the inner baton section.

* * * * *